United States Patent [19]

Gaffney et al.

[11] Patent Number: 4,891,164

[45] Date of Patent: Jan. 2, 1990

[54] METHOD FOR SEPARATING AND IMMOBILIZING RADIOACTIVE MATERIALS

[75] Inventors: Thomas R. Gaffney, Allentown, Pa.; JoAnn Henry, Bedford Heights; Michael J. Desmond, Cleveland Heights, both of Ohio

[73] Assignee: The Standard Oil Company, Cleveland, Ohio

[21] Appl. No.: 294,951

[22] Filed: Jan. 6, 1989

Related U.S. Application Data

[63] Continuation of Ser. No. 900,961, Aug. 28, 1986, abandoned.

[51] Int. Cl.[4] ..... G21F 9/16

[52] U.S. Cl. ..... 252/629; 252/628; 252/644; 423/14; 423/21.5; 501/152; 502/65; 502/73

[58] Field of Search ..... 252/626, 627, 631, 628; 423/2, 6, 7, 14, 21.5, 70, 328; 501/152, 54; 502/65, 73

[56] References Cited

U.S. PATENT DOCUMENTS

| | | | |
|---|---|---|---|
| 2,882,243 | 4/1959 | Milton | 252/455 |
| 2,882,244 | 4/1959 | Milton | 252/455 |
| 3,130,007 | 4/1964 | Breck | 23/113 |
| 3,329,384 | 10/1965 | Salzmann | 248/265 |
| 3,329,480 | 7/1967 | Young | 23/111 |
| 3,329,481 | 7/1967 | Young | 23/111 |
| 3,702,886 | 11/1972 | Argauer et al. | 423/328 |
| 3,709,979 | 1/1973 | Chu | 423/328 |
| 3,769,386 | 10/1973 | Rundell et al. | 423/263 |
| 3,832,449 | 8/1974 | Rosinski et al. | 423/328 |
| 4,192,778 | 3/1980 | Alafandi et al. | 252/455 |
| 4,208,305 | 6/1980 | Kouwenhoven et al. | 252/431 |
| 4,238,315 | 12/1980 | Patzer, II | 208/11 |
| 4,312,774 | 1/1982 | Macedo et al. | 252/629 |
| 4,329,328 | 5/1982 | McAnespie et al. | 423/333 |
| 4,337,176 | 6/1982 | Boersma et al. | 252/459 |
| 4,338,215 | 7/1982 | Shaffer et al. | 252/628 |
| 4,339,354 | 7/1982 | Gladrow et al. | 252/455 |
| 4,486,397 | 12/1984 | Eshraghi et al. | 423/306 |
| 4,528,011 | 7/1985 | Macedo et al. | 252/629 |
| 4,663,113 | 5/1987 | Jester et al. | 376/256 |

FOREIGN PATENT DOCUMENTS

| | | |
|---|---|---|
| 0044740 | 7/1981 | European Pat. Off. . |
| 0050525 | 10/1981 | European Pat. Off. . |

OTHER PUBLICATIONS

Hawley, 1981, The Condensed Chemical Dictionary–10th Edition, Van Nostrand Reinhold Co., New York, pp. 700, 1105–1106.

*Primary Examiner*—Howard J. Locker
*Attorney, Agent, or Firm*—Larry W. Evans; Joseph G. Curatolo; Sue E. Phillips

[57] ABSTRACT

A method is disclosed for separating and immobilizing a radioactive material comprising: contacting an aqueous medium containing said radioactive material with a reactive composition comprising at least one alkali metal, at least one Group IIIB metal and at least one phosphorus oxide; maintaining said reactive composition in contact with said aqueous medium for an effective period of time to react a desired amount of said radioactive material with said reactive composition to form a radioactive-material-containing composition; and separating said radioactive-material-containing composition from said aqueous medium. Radioactive-material-containing compositions exhibiting low leach rates are also disclosed.

65 Claims, No Drawings

METHOD FOR SEPARATING AND IMMOBILIZING RADIOACTIVE MATERIALS

This is a continuation of co-pending application Ser. No. 900,961 filed on Aug. 28, 1986, (now abandoned).

This application is a substitution of our abandoned application Ser. No. 864,692 filed May 19, 1986.

TECHNICAL FIELD

This invention relates to a method for separating and immobilizing radioactive materials using a reactive composition comprising at least one alkali metal, at least one Group IIIB metal (e.g., scandium, yttrium, lanthanum) and at least one phosphorus oxide. The reactive composition can be in the form of a performed mass or, alternatively, precursors of said preformed mass can be used. In a preferred embodiment the preformed mass is a molecular sieve.

BACKGROUND OF THE INVENTION

Radioactive wastes arise in a variety of chemical and physical forms at every stage of the nuclear fuel cycle. Some of the radioisotopes in these wastes are so long-lived that they must be isolated from the biosphere for many thousands of years. Although much work has been done over the last 30 years to develop techniques for separating and immobilizing these materials, much work remains to be done.

A significant problem has occurred in attempting to separate and immobilize radioactive materials (e.g., radioisotopes) from acidic waste streams that are generated by most if not all nuclear facilities. The current practice in treating such waste streams requires caustic precipitation of insoluble metal oxides and hydroxides followed by the removal of the base soluble metal ions with a zeolite ion exchange material (e.g., chabazite or Zeolon-900). The sludge which precipitates when the acidic stream is neutralized requires further treatment. The volume is reduced by evaporation and the solids are processed into a non-leachable form for storage or disposal. It would be advantageous to provide a simplified process that avoided the necessity of precipitating and treating such a sludge.

Acid stable ion exchange resins in place of the zeolite ion exchange material would allow removal of the radioactive waste without requiring caustic precipitation and subsequent sludge treatment. Acid stable ion exchange resins cannot, however, be used because of their limited thermal and radiation stability. The presence of heat generating isotopes (e.g., $^{37}Cs$ and $^{90}Sr$) necessitates that the exchange medium be stable towards radiation had high temperatures.

The term "molecular sieve" refers to a wide variety of positive ion containing crystalline materials of both natural and synthetic varieties which exhibit the property of acting as sieves on a molecular scale. A major class of molecular sieves are the zeolites, although other crystalline materials are included in the broad definition. Examples of such other crystalline materials include coal, special active carbons, porous glass, microporous beryllium oxide powders, and layer silicates modified by exchange with organic cations. See, D. W. Breck, "Zeolite Molecular Sieves: Structure, Chemistry, and Use", John Wiley & Sons, 1974.

Zeolites are crystalline, hydrated, framework aluminosilicates which are based on a three-dimensional network of $AlO_4$ and $SiO_4$ tetrahedra linked to each other by sharing all of the oxygens. Zeolites may be represented by the empirical formula $$M_{2/n}).Al_2O_3.xSiO_2.yH_2O$$

wherein, x is generally equal to or greater than 2 since $AiO_4$ tetrahedra are joined only to $Sio_4$ tetrahedra, and n is the cation valence. The framework contains channels and interconnected voids which are occupied by the cation, M, and water molecules. The cations may be mobile and exchangeable to varying degrees by other cations. Intracrystalline zeolitic water in many zeolites is removed continuously and reversibly. In many other zeolites, mineral and synthetic, cation exchange or dehydration may produce structural changes in the framework. Ammonium and alkylammonium cations may be incorporated in synthetic zeolites, e.g., $NH_4$, $Ch_3NH_3$, $(CH_3)_2NH_2$, $(CH_3)_3NH$, and $(CH_3)_4N$. In some synthetic zeolites, aluminum cations may be substituted by gallium ions and silicon ions by germanium or phosphorus ions. The latter necessitates a modification of the structural formula.

The structural formula of a zeolite is best expressed for the crystallographic unit cell as: $M_{x/n}[(AlO_2)_{33}(SiO_2)_y].wH_2O$ where M is the cation of valence n, w is the number of water molecules and the ratio y/x usually has values of 1–100 depending upon the structure. The sum (x+y) is the total number of tetrahedra in the unit cell. The complex within the [] represents the framework composition.

The zeolites described in the patent literature and published journals are designated by letters or other convenient symbols. Exemplary of these materials are Zeolite A (U.S. Pat. No. 2,882,243), Zeolite X (U.S. Pat. No. 2,882,244), Zeolite Y (U.S. Pat. No. 3,130,007), Zeolite ZSM-5 (U.S. Pat. No. 3,702,886), Zeolite ZSM-11 (U.S. Pat. No. 3,709,979), and Zeolite ZSM-12 (U.S. Pat. No. 3,832,449).

Although there are 34 species of zeolite minerals and over 150 types of synthetic zeolites, only a few have been found to have practical significance. Many of the zeolites, after dehydration, are permeated by very small channel systems which are not interpenetrating and which may contain serious diffusion blocks. In other cases dehydration irreversibly disturbs the framework structure and the positions of metal cations, so that the structure partially collapses and dehydration is not completely reversible. Zeolites generally have only limited stability in acid and thus the use of such zeolites in removing radioactive wastes from acidic nuclear waste streams is precluded.

There has been considerable interest in developing metallosilicates other than zeolites which exhibit molecular sieve characteristics. For example, U.S. Pat. Nos. 3,329,480 and 3,329,481 disclose crystalline zircano-silicates and titano-silicates, respectively. U.S. Pat. No. 3,329,384 discloses Group IVB metallosilicates. U.S. Pat. Nos. 4,208,305, 4,238,315 and 4,337,176 disclose iron silicates. U.S. Pat. No. 4,329,328 discloses zinco—, stanno—, and titano-silicates. European patent application Nos. 0 038 682 and 0 044 740 disclose cobalt silicates. European patent application No.0 050 525 discloses nickel silicate.

U.S. Pat. Nos. 3,769,386, 4,192,778 and 4,339,354 disclose rare earth metal containing silicates. U.S. Pat. No. 3,769,386 discloses zeolitic alumino-metallosilicates crystallized from an aqueous reaction mixture containing $Na_2O$, $SiO_2$, $Al_2O_3$and $R_{2/n}$ wherein R is Mg, Ca, Y, Fe, Co, Ni or a rare earth metal and n is the valence of R. U.S. Pat. No. 4,192,778 discloses rare earth exchanged zeolites of the faujasite type in which the equivalent of Na is less than 0.1 and the rare earth is at least 0.9 equivalent per gram atom of aluminum. U.S. Pat. No. 4,339,354 discloses a catalyst comprising a crystalline aluminosilicate such as zeolite Y, an inorganic matrix, and discrete particles of alumina, the catalyst having specified alkali metal and rare earth metal contents.

U.S. Pat. No. 4,486,397 discloses metallophosphate molecular sieves represented in terms of mole ratios of oxides by the formula $$x(M'_2O):y(M_2O_3):z(P_2O_5):nH_2O$$

wherein M' is an alkali metal, M is a Group IIIB metal, x/y is a number ranging from about 1.1 to about 1.9, z/y is a number ranging from about 1.1 to about 1.9, and n/y is a number ranging from zero to about 8. This patent, which issued to, among others, one of co-inventors (Michael J. Desmond) of the invention disclosed and claimed herein, indicates that these metallophosphate molecular sieves are useful as ion-exchange materials.

SUMMARY OF THE INVENTION

The present invention relates to a method for removing radioactive materials from an aqueous medium. An advantage of this invention is that a simplified process for removing radioactive materials from acidic nuclear waste streams is provided wherein the necessity of first neutralizing the nuclear waste stream and then removing precipitated metal oxides and hydroxides therefrom is avoided. This advantage is realized at least in part because the reactive compositions employed in accordance with the inventive method are acid stable and at the same time exhibit sufficiently high levels of thermal and radiation stability to be effective in the presence of heat generating isotopes. Another advantage of the present invention is that the product of this inventive method exhibits a sufficiently low leachability of radioactive materials so that the requirement for further treatment of such product for waste disposal or storage can be eliminated.

Broadly stated, the present invention contemplates the provision of a method for separating and immobilizing a radioactive material comprising: contacting an aqueous medium containing said radioactive material with a reactive composition comprising at least one alkali metal, at least one Group IIIB metal (e.g., scandium, yttrium, lanthanum) and at least one phosphorus oxide; maintaining said reactive composition in contact with said aqueous medium for an effective period of time to react a desired amount of said radioactive material with said reactive composition to form a radioactive-material-containing-composition; and separating said radioactive-material-containing composition from said aqueous medium. The reactive composition can be in the form of a preformed mass or, alternatively, the precursors of said preformed mas can be directly used. In a preferred embodiment, the preformed mass is in the form of a molecular sieve.

DESCRIPTION OF THE PREFERRED EMBODIMENTS

Reactive Compositions

The reactive compositions employed in the inventive method comprise at least one alkali metal, at least one Group IIIB metal (e.g., scandium, yttrium, lanthanum) and at least one phosphorus oxide. These reactive compositions can be in the form of a preformed mass that is formed prior to contact with the radioactive-material-containing aqueous medium in accordance with the inventive method. Alternatively, the precursor materials used in forming said preformed mass can be added directly to the radio-active-material-containing aqueous medium. When said precursor materials are directly added, the combination of said precursor materials constitutes the reactive composition employed in the inventive method. When a preformed mass is used, said preformed mass is preferably in the form of a molecular sieve.

The preformed masses and, in particular, the molecular sieves, generally comprise the combination of at least one alkali metal oxide, at least one Group IIIB metal oxide and at least one phosphorus oxide. The precursor combinations of said preformed masses generally comprise at least one alkali metal source, at least one Group IIIB metal source and at least one phosphorus oxide source. In the context of this invention, the terminology "alkali metal" is intended to read on said alkali metal oxide and said alkali metal source; the terminology "Group IIIB metal" is intended to read on said Group IIIB metal oxide and said Group IIIB metal source; and the terminology "phosphorus oxide" is intended to read on said phosphorus oxide and said phosphorus oxide source. Thus the terminology "reactive composition comprising at least one alkali metal, at least on Group IIIB metal and at least one phosphorus oxide" is used herein to read on both the preformed masses, including molecular sieves, as well as the precursors of said preformed masses.

The alkali metal oxide is preferably represented by the formula $M'_2O$ wherein M' is the alkali metal. The alkali metal source can be any alkali metal compound with the oxides, hydroxides and salts being preferred. Any alkali metal can be used. Lithium, sodium and potassium are preferred, and sodium is especially preferred. The salts include the inorganic salts (e.g., nitrates, phosphates, phosphites, halides, carbonates, sulfates, and the like) as well as the organic salts, (e.g., acetates, formates, butyrates, propionates, benzylates, tartrates and the like).

The Group IIIB metal oxide is preferably represented by the formula $M_2O_3$wherein M is the Group IIIB metal. The Group IIIB metal source can be any Group IIIB metal compound with the oxides, hydroxides and salts being preferred. Any Group IIIB metal can be used. Scandium, yttrium and lanthanum are preferred, and yttrium is especially preferred. The salts include the inorganic salts (e.g., nitrates, phosphates, phosphites, halides, carbonates, sulfates, and the like) as well as the organic salts, (e.g., acetates, formates, butyrates, propionates, benzylates, tartrates and the like).

The phosphorus oxide can be any of the phosphorus oxides including phosphorus monoxide ($P_2O$), phosphorus trioxide ($P_2O_3$), phosphorus tetroxide ($P_2O_4$) and phosphorus pentoxide ($P_2O_5$). The phosphorus oxide sources include the phosphoric acids, phosphates and phosphites. Examples of the phosphoric acids include orthophosphoric acid ($H_3PO_4$), metaphosphoric acid ($HPO_3$) and pyrophosphoric acid ($H_4P_2O_7$), with orthophosphoric acid being preferred. Eighty-five percent orthophosphoric acid, and commercially available mixtures of orthophosphoric acid, pyrophosphoric acid, triphosphoric acid and higher polyphosphoric acids are useful. The phosphates include any compound containing the group $PO_4^{\equiv}$ including the normal or tertiary phosphates ($X_3PO_4$), wherein X is a monovalent metal (e.g., sodium or potassium) or an ammonium group ($NH_4^+$); the monoacid, monohydric, dibasic or secondary phosphates ($X_2HPO_4$); the diacid, dihydric, monobasic or primary phosphates ($XH_2PO_4$); the double phosphates ($(X,X')PO_4$); the triple phosphates ($(X,X',X'')PO_4$); and the orthophosphates ($X_3PO_4$); as well as the hypophosphates ($X_4P_2O_6$); and the pyrophosphates ($X_4P_2O_7$). The phosphites include any compound containing the group $\equiv PO_3$ including the normal phosphites ($X_3PO_3$).

The mole ratio of the alkali metal source to the Group IIIB metal source is preferably in the range of from about 1 to about 12, more preferably from about 2 to about 8. The mole ratio of the phosphorous oxide source to the Group IIIB metal source is preferably from about 1 to about 10. These precursors can be premixed prior to addition to the aqueous medium in accordance with the inventive method, or they can be added separately to said aqueous medium without premixing. If the precursors are premixed, they are preferably mixed with water. Advantageously, the phosphorus oxide source is first mixed with water, the Group IIIB metal source is then added with stirring to form a suspension, the alkali metal source is then added with stirring to form the desired premix.

The preformed masses that are useful as the reactive compositions in the inventive method are preferably represented in terms of mole ratios of oxides by the formula $$x(M'_2O):y(M_2O_3):z(P_2O_5):nH_2O \quad (I)$$

wherein M' is an alkali metal, preferably sodium; M is a Group IIIB metal, preferably scandium, yttrium or lanthanum, more preferably yttrium; x/y is a number ranging from about 1.1 to about 1.9, z/y is a number ranging from about 1.1 to about 1.9, and n/y is a number ranging from zero to about 8.

In a preferred embodiment, these preformed masses are molecular sieves. These molecular sieves preferably exhibit a powder X-ray diffraction pattern observed with CuK-alpha radiation and a scan of 3° to 50° O of at least:

| Interplanar Spacing d(Å) | Relative Intensity |
|---|---|
| 16.0 ± 0.2 | s |
| 9.2 ± 0.2 | m |
| 7.9 ± 0.2 | w |
| 6.8 ± 0.1 | m |
| 5.45 ± 0.05 | m |
| 5.17 ± 0.05 | w |
| 4.49 ± 0.05 | w |
| 3.79 ± 0.03 | m-w |
| 3.69 ± 0.03 | w |
| 3.38 ± 0.03 | w |
| 3.17 ± 0.03 | w |
| 3.06 ± 0.03 | w |
| 2.99 ± 0.03 | m |
| 2.94 ± 0.02 | m |
| 2.86 ± 0.02 | w-m |
| 2.77 ± 0.02 | w-m |
| 2.72 ± 0.02 | m |
| 2.68 ± 0.02 | w-m |

In the above X-ray diffraction pattern as well as in the other patterns disclosed in this specification and the appended claims, the relative intensities are given in terms of the symbols vs=very strong, s=strong, m=medium, w=weak, and vw=very weak. All X-ray patterns were obtained using standard X-ray powder diffraction techniques. The radiation source was a standard intensity, copper target, X-ray tube operated at 40 Kv and 20 ma. The diffraction pattern from the K-alpha radiation was suitably recorded by an X-ray spectrometer scintillation counter, plus height analyzer and strip chart recorder. Flat compressed powder samples were scanned at 1° per minute, using a two-second time constant. Interplanar spacings d(A) were obtained from the position if the diffraction peaks expressed as 20 were O is the Bragg angle as observed on the strip chart. Intensities are determined from the heights of diffraction peaks after subtracting background.

The preformed masses and especially the molecular sieves that are useful as the reactive compositions in the inventive method are preferably prepared by the hydrothermal crystallization of a reaction mixture prepared by combining at least one phosphorus oxide source, at least one Group IIIB metal source and at least one alkali metal source (all of these sources being discussed above) and water. The reaction mixture, when properly mixed and dried, will have a composition in terms of mole ratios of oxides as shown in Formula (I). Preferably, the phosphorus oxide source is first added to the Group IIIB metal source and stirred until a precipitate is formed. The alkali metal source is then added to the mixture.

The reaction mixture is then placed in a reaction vessel which is inert towards the reaction mixture and heated at a temperature of at least about 70° C., preferably between about 125° C. to about 300° C. under autogenous pressure. The heating is continued until the reaction mixture is crystallized, usually a period from about two hours to about two weeks depending on the temperature of the preparation. Generally, at about 170° C. and autogenous pressure, the crystallization occurs in about five days.

The solid crystal in the reaction product is then recovered by any convenient method, such as filtration or centrifugation, then washed with water and dried at temperatures of between ambient and about 200° C., usually about 100° C. to about 120° C., in a suitable atmosphere such as air.

It is generally desirable during the synthesis of the preformed masses, and especially during the synthesis of the molecular sieves of this invention, to control the alkali metal to Group IIIB metal ratio used in the synthesis mixture with the ratio being dependent upon Group IIIB metal employed. A low alkali/Group IIIB metal ratio can result in the formation of an amorphous product while a high ratio can result in the formation of a crystalline product which does not exhibit the characteristic molecular sieve structure. Preferably, the alkali metal to Group IIIB metal ratio ranges from about 1 to about 12, more preferably from about 2 to about 8.

In a preferred embodiment, the phosphorus oxide source is orthophosphoric acid, the Group IIIB metal source is a metal oxide or metal halide, preferably oxide, the heating temperature is from about 150° C. to about 200° C. and the crystallization time is from about 1 to about 7 days.

The preformed masses used in accordance with the inventive method can be formed in a wide variety of particular sizes and shapes. Generally, the particles can be in the form of powder, a granule, or a molded product such as an extrudate. The following Examples 1 and 2 illustrate the preparation of preferred molecular sieves that are useful in accordance with the inventive method. Unless otherwise indicated, in the following Examples 1 and 2 as well as in all other examples and all parts of the specification and in the appended claims, all parts and percentages are by weight and all temperatures are in degrees centigrade.

EXAMPLE 1

A sodium-yttrium-phosphate molecular sieve was prepared by adding 4.60 grams of an 85% orthophosphoric acid solution to 12 grams of water to provide a dilute phosphoric acid solution. 4.48 grams of yttrium oxide ($Y_2O_3$) were added with stirring to the phosphoric acid solution to provide a uniform suspension. 6.56 grams of a 50% solution of sodium hydroxide were added to the suspension followed by the addition of 16 grams of water. The mixture was stirred thoroughly and placed into a Teflon-lined stainless steel digestion reactor and maintained therein at a temperature of 170° C. for 96 hours. The reactor contents were cooled to ambient temperature. The solid product was separated by filtration, thoroughly washed with one liter of water and dried for 3 hours at 95° C. This product was analyzed using emission spectroscopy and found to have a 20% by weight sodium content, a 28% by weight yttrium content and a 14% by weight phosphorus content. This product exhibited the following significant reflections in its X-ray diffraction pattern:

| Interplanar Spacing d(Å) | Relative Intensity |
|---|---|
| 15.9 | s |
| 9.2 | m |
| 7.95 | w |
| 6.79 | m |
| 6.23 | w |
| 5.45 | m |
| 5.15 | w |
| 4.58 | w |
| 4.48 | w |
| 4.38 | w |
| 4.17 | vw |
| 3.79 | w-m |
| 3.68 | w |
| 3.45 | w |
| 3.38 | w |
| 3.15 | w |
| 3.07 | w |
| 2.98 | m |
| 2.85 | w |
| 2.79 | w |
| 2.69 | w-m |
| 2.62 | w |
| 2.47 | vw |
| 2.43 | vw |
| 2.35 | vw |
| 2.26 | vw |
| 2.15 | m |
| 2.10 | vw |
| 2.06 | w |
| 2.03 | w |
| 2.01 | w |
| 1.89 | w |

EXAMPLE 2

A sodium-yttrium-phosphate molecular sieve was prepared by adding 15 grams of an 85% orthophosphoric acid solution to 30 grams of water to provide a dilute phosphoric acid solution. 11.2 grams of yttrium oxide were added with stirring to the phosphoric acid solution to provide a uniform suspension. 20 grams of a 50% solution of sodium hydroxide were added to the suspension followed by the addition of 40 grams of water. The mixture was stirred thoroughly and placed into a Teflon-lined stainless steel digestion reactor and maintained therein at a temperature of 170° C. for 137 hours. The reactor contents were cooled to ambient temperature. The solid product was separated by filtration, thoroughly washed with one liter of water and dried for 3 hours at 95° C. This product was analyzed using emission spectroscopy and found to have a 10% by weight sodium content, a 42% by weight yttrium content and a 14% by weight phosphorus content. This product exhibited the following significant reflections in its X-ray diffraction pattern:

| Interplanar Spacing d(Å) | Relative Intensity |
|---|---|
| 16.1 | s |
| 9.2 | m |
| 8.00 | w |
| 6.80 | s |
| 6.22 | w |
| 5.47 | m |
| 5.19 | vw |
| 4.60 | w |
| 4.51 | w |
| 4.41 | w |
| 3.80 | m |
| 3.69 | w |
| 3.46 | w |
| 3.39 | m |
| 3.18 | m |
| 3.08 | m |
| 2.95 | m |
| 2.85 | m |
| 2.78 | m |
| 2.72 | m |
| 2.68 | w |
| 2.63 | w |
| 2.46 | w |
| 2.42 | w |
| 2.26 | w |

Additional examples illustrating the preparation of molecular sieves that are useful in the inventive method are disclosed in U.S. Pat. No. 4,486,397, which is incorporated herein by reference.

Separation and Immobilization Method:

No completely valid generalizations can be made about the composition of the nuclear waste streams that can be treated in accordance with the inventive method. The compositions of such streams vary widely depending upon the specific nuclear process involved and the point in the process at which the waste stream is generated. Large variations in the composition of a single waste stream can also occur from tank to tank, within each tank, and with time. In this regard, reference is made to the publication edited by Milton H. Campbell entitled "High-Level Radioactive Waste Management", Advances In Chemistry Series 153, American Chemical Society, Washington, D.C., 1976, and, in particular, the article by R. M. Wallace et al, entitled "Solid Forms for Savannah River Plant Radioactive Wastes", appearing at pages 9–30 of said publication, the disclosures in said publication and said article being incorporated herein by reference.

The waste streams that can be treated in accordance with the inventive method will in general be aqueous mediums containing one or more radioisotopes selected from Sr, Cs, Th, U, Np, Pu, Am, Cm. The concentration of said radioisotopes in the aqueous medium will generally range up to a total of about 1% by weight, but can be greater than about 1% by weight. The aqueous medium is typically acidic with the pH ranging up to about 5, preferably from about zero to about 5. The temperature of the aqueous medium generally ranges from about 20° C. to the boiling point of said medium.

The reactive composition used in the inventive method, whether it be in the form of a preformed mass or molecular sieve, or the precursor materials thereof, and the aqueous medium can be contacted in any conventional manner. The ratio of reactive composition to radioactive material is dependent upon the total concentration of radioisotopes in the radioactive waste and the concentration of phosphorus in the reactive composition. Preferably, the molar ratio of phosphorus to total concentration of radioisotopes is at least about 1:1, but higher ratios can also be used. Ratios of lower than 1:1 can be used but at such lower ratios it is not likely that all of the radioisotopes will be satisfactorily reacted. Contact can be effected in a suitable ion-exchange reactor which is preferably equipped with an agitator or other suitable mixing capability. Contact is preferably continued for an effective period of time to react a desired amount of the radioactive material with the reactive composition. The time required to effect such a reaction is dependent upon the concentration of the radioactive material in the aqueous medium but generally ranges from about one hour to about two days, preferably from about 18 hours to about two days. Upon completion of the reaction, the resulting radioactive-material-containing composition is separated from the aqueous medium using conventional separation techniques such as filtration, centrifugation, etc.

The radioactive-material-containing compositions produced by the inventive method are represented in terms of mole ratios by the formula $$x(M_2'O):y(M_2O_3):z(P_2O_5):g(GO_a):nH_2O$$

wherein M' is an alkali metal, preferably sodium; M is a Group IIIB metal, preferably scandium, yttrium, or lanthanum, more preferably yttrium; G is a radioisotope, preferably Sr, Cs, Th, U, Np, Pu, Am, Cm or a mixture of two or more thereof, more preferably U; x/y is a number ranging from about zero to about 1.9, z/y is a number ranging from about 1.1 to about 1.9, g/y is a number ranging from about 0.05 to about 10, and n/y is a number ranging from zero to about 8.

An advantage of these radioactive-material-containing compositions is that they exhibit significantly low levels of leachability of the radioactive material. In this regards, the leach rates for these products are generally in the range of about $10^{31\,3}$ or less gram/m$^2$-day, preferably about $10^{-4}$ or less gram/m$^2$-day. (The leach rate is measured by the formula $L1=(A_t/A_O)\ (W_O/St)$ wherein L1 is the leach rate in gram/m$^2$-day, $A_t$ is the amount of isotope A removed in time t, $A_O$ is the initial amount of isotope A is the solid, S is surface area of the solid, $W_O$ is the initial weight of the solid, and t is the leach period.) These radioactive-material-containing compositions appear to be amorphous. That is, the X-ray diffraction patterns for these products do not exhibit any or significant crystalline structure. These compositions can be effectively stored in long-term storage facilities wherein multiple containerization procedures are employed (e.g., conversion to borosilicate glass ingots cast in stainless steel containers).

Alternatively, the radioactive-material-containing compositions produced by the inventive method can be heat-treated in such a manner so as to decrease the surface area and thus reduce even further the leachability of the radioactive material from such radioactive-material-containing composition and enhance the thermal stability of these products. the heat-treating step is preferably conducted in air at a temperature in the range of about 1000° C. to about 2000° C., preferably at a temperature of about 1500° C. The procedure for performing this heat-treating step preferably involves increasing the temperature of said radioactive-material-containing composition at a rate of about 20° C. per minute until the desired temperature is achieved. The composition is then maintained at that temperature for about one hour to about 7 days, preferably about 3 hours to about one day. The heat-treated radioactive-material-containing compositions exhibit a crystlline structure. The X-ray diffraction patterns for these crystalline structures show at least the following significant lines:

| Interplanar Spacing d(Å) | Relative Intensity |
|---|---|
| 3.15 ± 0.05 | s |
| 2.73 ± 0.05 | m |
| 1.931 ± 0.05 | m |

These heat-treated compositions can be effectively stored in stainless steel drums or equivalent containers on a long-term basis without additional treatment or containerization.

Examples 3–7 are illustrative of the use of preformed sodium-yttrium-phosphate molecular sieves in the inventive method. In Example 3, comparative tests between the use of Zeolites NaA and NaY, and the sodium-yttrium-phosphate molecular sieve of Example 1 in the separation of uranium from a acidic aqueous medium are disclosed. Zeolite NaA was studied because of its relatively high ion-exchange capacity. Zeolite NaY was studied because it also has a relatively high ion-exchange capacity and because it is known to be more stable in acid than Zeolite NaA.

EXAMPLE 3

1.0012 grams of the product of Example 1 were mixed with constant stirring with 200 ml. of 0.11M. uranyl acetate [$UO_2(OOCCH_3)_2.2H_2O$, depleted] solution at ambient temperature for 45 hours to provide an ion-exchanged Example 1 product. The uranyl acetate solution has a pH of 4. 1.0184 grams of Linde LZY-52 (a product of Union Carbide identified as Zeolite NaY), and 1.0097 grams of Linde 4A (a product of Union Carbide identified as Zeolite NaA) were likewise mixed with constant stirring with separate aliquots of 200 ml. of 0.11M uranyl acetate solution for 45 hours at ambient temperature. the solids (if present) from each sample were filtered and air dried. The Zeolite NaA was completely digested and no solid was recovered. The Zeolite NaY was partially digested as judged by the weight loss of solid in the exchange experiment; 0.887 gram of solid was recovered. In contrast, the sample employing the product of Example 1 showed a large weight gain upon exchange; 2.555 grams of solid was recovered. The X-ray diffraction pattern for the ion-exchanged Example 1 product was essentially X-ray amorphous. The Zeolite NaY and Example 1 products had the following elemental analysis (all numerical values being in percent by weight):

| | Before Exchange | | | | After Exchange | | | |
|---|---|---|---|---|---|---|---|---|
| | Na | Y | P | U | Na | Y | P | U |
| Example 1 | 10 | 28 | 14 | — | 0.1 | 7.4 | 5.1 | 53 |
| Zeolite NaY | 7.5 | 20 | 9.0 | — | 2.0 | 20 | 9.5 | 5.0 |

The results indicate that the sodium-yttrium,-phosphate molecular sieve of Example 1 is superior to Zeolite NaA or Zeolite NaY for separating uranium from an acidic aqueous medium.

EXAMPLE 4

0.1019 gram of the ion-exchanged Example 1 product from Example 3 was placed in a Teflon-lined bomb and 7.00 grams of distilled water were added. The bomb was sealed and incubated at 90° C. for 120 hours and then cooled to ambient temperature. The solid product was separated by filtration and washed. The solid product, filtrate and washings were analyzed. The analysis revealed a leach rate of uranium of less than $2.6\times10^{-5}$ gram/$m^2$-day.

EXAMPLE 5

0.3625 gram of the ion-exchanged Example 1 product from Example 3 was heated in air at 120° C. for 4 hours, then at 1000° C. for 6 hours. The weight loss was 15.2% by weight. This product was essentially X-ray amorphous. 0.105 gram of this product was placed in a Teflon-lined bomb to which 7 grams of distilled water were added. The bomb was sealed and incubated at 90° C. for 120 hours. The bomb was then cooled to ambient temperature, and the solid product was separated by flirtation and washed. The solid product, filtrate and washings were analyzed and revealed a leach rate of uranium of $1.1\times10^{-3}$ gram/$m^2$-day.

EXAMPLE 6

0.3069 gram of the ion-exchanged Example 1 product from Example 3 was placed in a porcelain crucible and heated in air to 1500° C. over a period of 1.25 hours. The product was then maintained at 1500° C. for an additional 6 hours. The product was cooled to ambient temperature. The cooled product weighed 0.2514 gram indicating a loss on ignition (LOI) of 22%. This product exhibited the following significant reflections in its X-ray diffraction pattern:

| Interplanar Spacing d(A) | Relative Intensity |
|---|---|
| 4.19 | w* |
| 4.11 | w |
| 3.44 | w* |
| 3.13 | s** |
| 2.71 | m** |
| 2.65 | w* |
| 2.57 | w |
| 1.91 | m** |

The diffraction pattern indicates the presence of a mixture of oxides including structures that are $U_3O_8$-like (identified by *) and $U_3O_7$-like (identified by **). 0.0998 gram of this product was placed in a Teflon-lined bomb with 8.00 grams of distilled water. The bomb was sealed and incubated at 90° C. for 120 hours. The bomb was cooled, and the solid product was separated by filtration and washed. An analysis of the solid product, filtrate and washings revealed a uranium leach rate of $2\times10^{-4}$ gram/$m^2$-day.

EXAMPLE 7

Two one-gram samples of the sodium-yttrium-phosphate molecular sieve of Example 2 were combined with separate aliquots of 200 ml. of a 0.01M. solution of uranyl acetate and stirred. After one hour, a first solid product was recovered from the first sample by filtration and thoroughly washed with distilled water. This first solid product had a weight of 1.13 grams and was found to have a 4.3% by weight sodium content, a 36% by weight yttrium content, a 12% by weight phosphorus content and a 9.1% by weight uranium content. This first solid product exhibited a generally broad X-ray diffraction pattern with the following resolvable reflections:

| Interplanar Spacing d(A) | Relative Intensity |
|---|---|
| 15.7 | s |
| 9.1 | w |
| 7.9 | w |
| 6.8 | W |
| 4.48 | w |
| 3.78 | w |
| 3.16 | w |
| 3.06 | w |

After 24 hours, a second solid product was recovered from the second sample by filtration and thoroughly washed with distilled water. This second solid product had a weight of 1.58 grams and was found to have a 2.7% by weight sodium content, a 26% by weight yttrium content, an 8.6% by weight phosphorus content and a 25% by weight uranium content. This second solid product appeared to be more crystalline than said first solid product. This second solid product exhibited the following sharp reflections in its X-ray diffraction pattern:

| Interplanar Spacing d(A) | Relative Intensity |
|---|---|
| 15.6 | m |
| 9.1 | w |
| 7.3 | s* |
| 6.8 | w |
| 3.66 | m* |
| 3.58 | s* |
| 3.50 | m* |
| 3.22 | s* |
| 3.16 | m* |
| 3.04 | w |
| 2.56 | w* |
| 2.08 | w |
| 2.05 | w* |
| 2.01 | w |
| 1.97 | w |

The diffraction pattern indicates the possible presence of multiple phases, including $UO_3.2H_2O$-like structures (identified by *).

The following Examples 8–11 illustrate the use of a reactive composition comprising a sodium source, a yttrium source and a phosphorus oxide source which is added directly to a uranium-containing aqueous medium without first being formed into a preformed mass.

EXAMPLE 8

0.601 gram of sodium dihydrogen phosphate ($NaH_2PO_4$) and 0.955 gram of yttrium chloride ($YCl_3.6H_2O$) were added to a 250 ml. Erlenmeyer flask. 200 ml. of a 0.2M. uranyl acetate aqueous solution were then added to the flask with stirring. 0.04 gram of an 85% aqueous solution of phosphoric acid ($H_3PO_4$) was added and the mixture was stirred at ambient temperature for 45 hours. 3.46 grams of a solid product were recovered by filtration and washed with distilled water. This product was found to have a sodium content of less than 0.1% by weight, a yttrium content of 3.4% by weight, a phosphorus content of 4.5% by weight and a uranium content of 51% by weight. This product was found to be essentially X-ray amorphous and had a surface area (BET) of 19.4 $m^2$/gram.

EXAMPLE 9

0.9331 gram of the product of Example 8 was placed in a porcelain boat and calcined at 1000° C. for six hours to produce a calcined product. This calcined product was cooled to ambient temperature and found to have a weight of 0.6176 gram indicting a 34% weight loss (LOI). The surface area (BET) of this calcined product was found to be 3.6 $m^2$/gram. This calcined product was observed to have good crystallinity, and it exhibited the following significant reflections in its X-ray diffraction pattern:

| Interplanar Spacing d(A) | Relative Intensity |
|---|---|
| 10.4 | w |
| 8.6 | s |
| 7.0 | w |
| 6.22 | w |
| 5.87 | w |
| 5.22 | s |
| 4.82 | w |
| 4.27 | s |
| 4.21 | s |
| 4.15 | m |
| 3.53 | m-s |
| 3.42 | s |
| 3.27 | m |
| 2.99 | m-s |
| 2.93 | m |
| 2.81 | m |
| 2.73 | w |
| 2.61 | m |
| 2.45 | w |
| 2.27 | w |
| 1.96 | w |
| 1.87 | w |

This diffraction pattern suggests the presence of multiple phases, including yttrium uranyl phosphates and uranium oxide ($U_3O_8$) like phases.

EXAMPLE 10

0.4984 gram of the product of Example 8 was placed in a Teflon-lined bomb with 7 ml. of distilled water, sealed and incubated at 90° C. for 120 hours. The bomb was cooled to ambient temperature and the solid product was separated by filtration and washed. The solid product, filtrate and washings were analyzed. The analysis revealed that less than 0.04% of the uranium had been removed from the solid product resulting in a leach rate of uranium of less than $2.4\times10^{-6}$ gram/$m^2$-day. The leached product was observed to exhibit a small amount of crystallinity and had the following broad reflections in its X-ray diffraction pattern:

| Interplanar Spacing d(A) | Relative Intensity |
|---|---|
| 8.6 | s* |
| 5.86 | w* |
| 5.24 | m* |
| 4.79 | w |
| 4.23 | m* |
| 3.52 | m* |
| 3.26 | m* |
| 3.08 | m |
| 2.98 | m |
| 2.82 | w |
| 2.72 | w |
| 2.44 | w |
| 2.14 | w |
| 1.87 | w* |

The diffraction pattern suggests the possible presence of multiple phases, including $(UO_2)HPO_4.2H_2O$-like material (identified by *).

EXAMPLE 11

0.4615 gram of the product of Example 9 was placed in a Teflon-lined bomb and 7.03 grams of distilled water were added. The bomb was sealed and incubated at 90° C. for 120 hours. The solid product, filtrate and washings were analyzed. The analysis revealed that 26.2% by weight of the uranium had been leached out corresponding to a leach rate of uranium of $1.1\times10^{-2}$ gram/$m^2$-day. The X-ray diffraction pattern of the leached solid product was unchanged relative to that of the starting material with respect to the interplanar lattice spacings that were observed.

Examples 12–16 are provided to demonstrate the significant advantages of employing a Group IIIB metal in the reactive composition employed in the inventive method. Examples 12–14, which are not within the scope of the invention, are provided for purposes of comparison.

EXAMPLE 12

0.6003 gram of sodium dihydrogen phosphate was added to a 250 ml. Erlenmeyer flask. 200 ml. of a 0.2 M. uranyl acetate aqueous solution were added to the flask with stirring. 0.02 gram of an 85% aqueous solution of phosphoric acid was then added and the mixture was stirred at ambient temperature for 45 hours. 3.506 grams of a solid product were recovered by filtration and washed with distilled water. This product was found to have a 0.11% by weight sodium content, a 3.7% by weight phosphorus content and a 63% by weight uranium content. The X-ray diffraction pattern for this product indicated that it was essentially amorphous. The surface area (BET) was 0.03 $m^2$/gram.

EXAMPLE 13

1.3053 grams of the product of Example 12 were placed in a porcelain boat and calcined at 1000° C. for six hours. The calcined product was cooled to ambient temperature, and was found to have a weight of 1.0969 grams indicating a 16% weight loss (LOI). The surface area (BET) of this calcined product was found to be 0.78 $m^2$/gram. This product was observed to have good crystallinity and exhibited the following significant reflections in its X-ray diffraction pattern:

| Interplanar Spacing d(A) | Relative Intensity |
|---|---|
| 8.3 | m |
| 6.43 | w |
| 6.15 | w |
| 5.15 | m |
| 4.60 | w |
| 4.13 | s* |
| 3.50 | w |
| 3.38 | m* |
| 3.32 | w |
| 3.22 | w |
| 2.97 | m |
| 2.89 | w |
| 2.80 | w |
| 2.67 | w |
| 2.61 | m* |
| 2.41 | w |
| 2.19 | w |
| 2.13 | w |
| 2.05 | w |
| 1.94 | w |

This diffraction pattern indicates the presence of a number of phases, including $U_3O_8$ (major reflections being identified by *).

EXAMPLE 14

0.4547 gram of the product of Example 12 was placed in a Teflon-lined bomb with 7 ml. of distilled water. The bomb was sealed and incubated at 90° C. for 120 hours and then cooled to ambient temperature. The solid product was separated by filtration and washed. The solid product, filtrate and washings were analyzed. The analysis revealed that the leach rate of uranium was $6\times10^{-3}$ gram/m$^2$-day. The X-ray diffraction pattern of the solid product indicated that it was essentially amorphous. The difference between the leach rate observed in this example and the leach rate observed in Example 4 is significant and demonstrates the superior characteristics of this invention.

EXAMPLE 15

0.2395 gram of the uranium-yttrium-phosphate product of Example 9 and 0.2465 gram of the uranium-phosphate product of Example 13 were placed in separate porcelain crucibles, calcined at 1500° C. for 8 hours and then cooled to ambient temperature. The calcined uranium-yttrium-phosphate product weighed 0.185 gram, indicating a weight loss (LOI) of 23%, and had a surface area (BET) of 0.43 m$^2$/gram. This calcined uranium-yttrium-phosphate product had a sodium content of less than 0.2% by weight, a phosphorus content of less than 0.1% by weight, a yttrium content of 5.3% by weight, and a uranium content of 81% by weight. The calcined uranium-phosphate product of Example 9 weighed 0.203 gram, indicating a weight loss (LOI) of 18%, and had a surface area of 0.30 m$^2$/gram. This calcined uranium-phosphate product had a sodium content of less than 0.2% by weight, a phosphorus content of less than 0.1% by weight and a uranium content of 87% by weight. Both of these calcined products exhibited the following significant lines in their X-ray diffraction patterns:

| Interplanar Spacing d(A) | Relative Intensity |
|---|---|
| 3.15 | s |
| 2.73 | m |

-continued

| Interplanar Spacing d(A) | Relative Intensity |
|---|---|
| 1.931 | m |

These reflections indicate the presence of $U_3O_7$-type structures.

EXAMPLE 16

0.119 gram of the calcined uranium-yttrium-phosphate product of Example 15, and 0.113 gram of the calcined uranium-phosphate of Example 15 were each placed in separate Teflon-lined bombs with 7 ml. of distilled water, sealed and incubated at 90° C. for 120 hours. The bombs were cooled to ambient temperature and the solid products were separated by filtration and then washed. The solid products, filtrates and washings were analyzed. The leach rate of uranium from the calcined uranium-yttrium-phosphate product was found to be less than $4\times10^{-5}$ gram/m$^2$-day, while the leach rate of uranium for the calcined uranium-phosphate product was found to be $1.3\times10^{-3}$ gram/m$^2$-day. Both of the leached products exhibited essentially the same X-ray diffraction patterns, and these patterns were essentially the same patterns observed prior to leaching (see Example 15).

While the invention has been explained in relation to its preferred embodiment, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A method for separating and immobilizing a radioactive material comprising:

contacting an acidic aqueous medium containing said radioactive material with an acid stable reactive composition comprising at least one alkali metal, at least one Group IIIB metal and at least one phosphorus oxide;

maintaining said reactive composition in contact with said aqueous medium for an effective period of time to react a desired amount of said radioactive material with said acid stable reactive composition to form an amorphous or essentially amorphous radioactive-material-containing compositions; and separating said amorphous or essentially amorphous radioactive-material-containing composition from said aqueous medium.

2. The method of claim 1 wherein said reactive composition is a preformed mass.

3. The method of claim 1 wherein said reactive composition is a preformed molecular sieve.

4. The method of claim 1 wherein the mole ratio of said alkali metal to said Group IIIB metal is from about 1.1 to about 1.9.

5. The method of claim 1 wherein the mole ratio of said phosphorus oxide to said Group IIIB is from about 1.1 to about 1.9.

6. The method of claim 1 wherein said reactive composition comprises a precursor combination of at least one alkali metal source, at least one Group IIIB metal source and at least one phosphorous oxide source.

7. The method of claim 6 wherein the mole ratio of said alkali metal source to said Group IIIB metal source is from about 1 to about 12.

8. The method of claim 6 wherein the mole ratio of said alkali metal source to said Group IIIB metal source is from about 2 to about 8.

9. The method of claim 6 wherein the mole ratio of said phosphorus oxide source to said Group IIIB metal source is from about 1 to about 10.

10. The method of claim 1 wherein said radioactive material is selected from the group consisting of Sr, Cs, Th, U, Np, Pu, Am, Cm or a mixture of two or more thereof.

11. The method of claim 1 wherein said aqueous medium has a pH of up to about 5.

12. The method of claim 1 wherein said aqueous medium has a pH in the range of about zero to about 5.

13. The method of claim 1 wherein the temperature of said aqueous medium ranges from about 20° C. up to the boiling point of said aqueous medium.

14. The method of claim 1 wherein the concentration of said radioactive material in said aqueous medium ranges up to about 1% by weight.

15. The method of claim 1 wherein the concentration of said radioactive material in said aqueous medium is greater than about 1% by weight.

16. The method of claim 1 wherein said radioactive material comprises uranium.

17. The method of claim 1 wherein said reactive composition is a preformed mass represented in terms of mole ratios of oxides by the formula $$x(M'_2O):y(M_2O_3):z(P_2O_5):nH_2O$$

wherein

M' is an alkali metal,

M is a Group IIIB metal, x/y is a number ranging from about 1.1 to about 1.9, z/y is a number ranging from about 1.1 to about 1.9, and n/y is a number ranging from zero to about 8.

18. The method of claim 17 wherein said preformed mass is a molecular sieve.

19. The method of claim 17 wherein M' is sodium.

20. The method of claim 17 wherein M is scandium, yttrium, lanthanum or a mixture of two or more thereof.

21. The method of claim 17 wherein M is yttrium.

22. The method of claim 18 wherein said molecular sieve shows the following significant lines in its X-ray diffraction pattern:

| Interplanar Spacing d(A) | Relative Intensity |
|---|---|
| 16.0 ± 0.2 | s |
| 9.2 ± 0.2 | m |
| 7.9 ± 0.2 | w |
| 6.8 ± 0.1 | m |
| 5.45 ± 0.05 | m |
| 5.17 ± 0.05 | w |
| 4.49 ± 0.05 | w |
| 3.79 ± 0.03 | w-m |
| 3.69 ± 0.03 | w |
| 3.38 ± 0.03 | w |
| 3.17 ± 0.03 | w |
| 3.06 ± 0.03 | w |
| 2.99 ± 0.03 | m |
| 2.94 ± 0.02 | m |
| 2.86 ± 0.02 | w-m |
| 2.77 ± 0.02 | w-m |
| 2.72 ± 0.02 | m |
| 2.68 ± 0.02 | w-m |

23. The method of claim 17 wherein said preformed mass is a molecular sieve, said molecular sieve being made by the process comprising:

(A) forming a mixture comprising at least one alkali metal source, at least one Group IIIB source, and at least one phosphorus oxide source;

(B) maintaining said mixture at a temperature of at least about 70° C. under autogenous pressure until crystals are formed; and (C) separating said crystals from their mother liquor.

24. The method of claim 23 wherein the mole ratio of said alkali metal source to said Group IIIB source is in the range of from about 1 to about 12.

25. The method of claim 23 wherein the mole ratio of said source for said phosphorus oxide source to said Group IIIB metal source is from about 1 to about 10.

26. The method of claim 23 wherein said phosphorus oxide source is a phosphoric acid, a phosphate or a phosphite.

27. The method of claim 23 wherein said Group IIIB metal source is an oxide, hydroxide or salt of said metal.

28. The method of claim 23 wherein said alkali metal source is an oxide, hydroxide or salt of said metal.

29. The method of claim 6 wherein said phosphorus oxide source is selected from the group consisting of a phosphoric acid, a phosphate or a phosphite.

30. The method of claim 6 wherein said Group IIIB metal source is an oxide, hydroxide or salt of said metal.

31. The method of claim 6 wherein said alkali metal source is an oxide, hydroxide or salt of said metal.

32. The method of claim 6 wherein said phosphorus oxide source is phosphoric acid.

33. The method of claim 6 wherein said alkali metal is sodium.

34. The method of claim 6 wherein said Group IIIB metal is yttrium.

35. The method of claim 1 wherein said reactive composition is a preformed mass, said alkali metal is sodium, said Group IIIB metal is yttrium and said phosphorus oxide is phosphorus pentoxide.

36. The method of claim 35 wherein said preformed mass is a molecular sieve.

37. The method of claim 1 wherein said reactive composition is a preformed mass derived from a mixture comprising sodium hydroxide, yttrium oxide and phosphoric acid.

38. The method of claim 37 wherein said preformed mass is a molecular sieve.

39. The method of claim 1 wherein said reactive composition comprises a sodium source, a yttrium source and a phosphorus oxide source.

40. The method of claim 1 with the step of heat-treating said radioactive-material-containing composition at a temperature in the range of about 1000° C. to about 2000° C. for an effective period of time to reduce the leachability of said radioactive material from said radioactive-material-containing composition and enhance the thermal stability of said radioactive-material-containing composition.

41. The method of claim 1 with the step of heat-treating said radioactive-material-containing composition at a temperature of about 1500° C. for an effective period of time to reduce the leachability of said radioactive material from said radioactive-material-containing composition and enhance the thermal stability of said radioactive-material-containing composition.

42. The method of claim 40 wherein said period of time for said heat-treating step is in the range of about one hour to about 7 days.

43. The method of claim 41 wherein said period of time for said heat-treating step is in the range of about one hour to about 7 days.

44. The method of claim 40 wherein the product of said heat-treating step is a heat-treated-radioactive-material-containing composition, the X-ray diffraction pattern for said heat-treated-radioactive-material-containing composition showing at least the following significant lines:

| Interplanar Spacing d(A) | Relative Intensity |
|---|---|
| 3.15 ± 0.05 | s |
| 2.73 ± 0.05 | m |
| 1.931 ± 0.05 | m |

45. The method of claim 1 wherein said radioactive material comprises at least one radioisotope, the molar ratio of phosphorus in said reactive composition to said radioisotope being at least about 1:1.

46. The radioactive-material-containing composition produced by the method of claim 1.

47. The radioactive-material-containing composition produced by the method of claim 6.

48. The radioactive-material-containing composition produced by the method of claim 7.

49. The radioactive-material-containing composition produced by the method of claim 18.

50. The radioactive-material-containing composition produced by the method of claim 23.

51. The radioactive-material-containing composition produced by the method of claim 35.

52. The radioactive-material-containing composition produced by the method of claim 37.

53. The radioactive-material-containing composition produced by the method of claim 31.

54. The radioactive-material-containing composition produced by the method of claim 40.

55. The radioactive-material-containing composition produced by the method of claim 41.

56. The heat-treated-radioactive-material-containing composition produced by the method of claim 44.

57. A composition comprising at least one radioactive material, at least one Group IIIB metal and at least one phosphorus oxide, said composition being characterized by a leach rate of said radioactive material of $10^{-3}$ or less gram/$m^2$-day.

58. The composition of claim 57 wherein said leach rate of said radioactive material is $10^{-4}$ or less gram/$m^2$-day.

59. The composition of claim 57 wherein said radioactive material comprises Sr, Cs, Th, U, Np, Pu, Am, Cm or a mixture of two or more thereof.

60. The composition of claim 57 wherein said radioactive material is uranium.

61. The composition of claim 57 wherein said Group IIIB metal is yttrium

62. The composition of claim 57 wherein said composition comprises an amorphous structure.

63. The composition of claim 57 wherein said composition comprises a crystalline structure.

64. The composition of claim 57 wherein said composition comprises a crystalline structure, the X-ray diffraction for said crystalline structure showing at least the following significant lines:

| Interplanar Spacing d(A) | Relative Intensity |
|---|---|
| 3.15 ± 0.05 | s |
| 2.73 ± 0.05 | m |
| 1.931 ± 0.05 | m |

65. A radioactive-material-containing composition represented in terms of mole ratios by the formula $$x(M_2'O):y(M_2O_3):z(P_2O_5):g(GO_d):nH_2O$$

wherein M' is an alkali metal; M is a Group IIIB metal; G is a radioisotope; x/y is a number ranging from about zero to about 1.9, z/y is a number ranging from about 1.1 to about 1.9, g/y is a number ranging from about 0.05 to about 10, and n/y is a number ranging from zero to about 8.

* * * * *